US008832912B2

(12) United States Patent
Ha

(10) Patent No.: US 8,832,912 B2
(45) Date of Patent: Sep. 16, 2014

(54) APPARATUS FOR FASTENING SHOELACE

(76) Inventor: Ki Ho Ha, Busan (KR)

( * ) Notice: Subject to any disclaimer, the term of this patent is extended or adjusted under 35 U.S.C. 154(b) by 381 days.

(21) Appl. No.: 13/371,959

(22) Filed: Feb. 13, 2012

(65) Prior Publication Data

US 2013/0025100 A1 Jan. 31, 2013

(30) Foreign Application Priority Data

Jul. 25, 2011 (KR) ..... 10-2011-0073439

(51) Int. Cl.
*A43C 7/00* (2006.01)
*A43C 11/16* (2006.01)

(52) U.S. Cl.
CPC ..... *A43C 11/165* (2013.01)
USPC ..... 24/712.9; 24/68 B; 24/68 SK

(58) Field of Classification Search
CPC ..... A43C 11/165
USPC ..... 24/712.9, 68 B, 68 SK; 36/50.5
See application file for complete search history.

(56) References Cited

U.S. PATENT DOCUMENTS

| | | | | |
|---|---|---|---|---|
| 8,091,182 | B2 * | 1/2012 | Hammerslag et al. | 24/68 SK |
| 8,468,657 | B2 * | 6/2013 | Soderberg et al. | 24/68 SK |
| 8,516,662 | B2 * | 8/2013 | Goodman et al. | 24/68 SK |
| 2005/0081339 | A1 | 4/2005 | Sakabayashi | |
| 2010/0139057 | A1 * | 6/2010 | Soderberg et al. | 24/68 R |

FOREIGN PATENT DOCUMENTS

| | | | | |
|---|---|---|---|---|
| DE | 202011103135 | U1 * | 12/2011 | A43C 7/00 |
| KR | 101025134 | | 3/2011 | |

* cited by examiner

*Primary Examiner* — Robert J Sandy
(74) *Attorney, Agent, or Firm* — AKC Patents LLC; Aliki K. Collins

(57) ABSTRACT

An apparatus for fastening a shoelace includes a housing, a rotating cover, a reel part, and a restricting member. The housing includes a ratchet gear. The restricting member includes a repulsion restricting part which is provided between the rotating cover and the reel part and includes a ratchet coupling part protruding from an external circumference thereof to restrict a rotation in one direction by the ratchet gear, and a pressure coupling part which is slidably contacted and pressed by a rotation of the restricting projection in the other direction along a rotational radius and is repulsively deformed and selectively coupled to the coupling accommodation part.

5 Claims, 6 Drawing Sheets

APPARATUS FOR FASTENING SHOELACE

RELATED APPLICATIONS

This application claims the benefit of Korean Patent Application No. 10-2011-0073439, filed Jul. 25, 2011 in the Korean Intellectual Property Office, which is incorporated herein by reference in its entirety.

TECHNICAL FIELD

The present invention relates to an apparatus for fastening a shoelace, and more particularly, to an apparatus for fastening a shoelace which is easy to configure and manipulate and provides improved convenience and productivity.

BACKGROUND ART

Generally, shoes such as sneakers have a shoelace connected in zigzag pattern to be closely adhered to the foot of a user. Such shoelace is pulled and fastened to thereby adhere the shoes to the foot of a user and ensure a comfortable walk.

A user should choose shoes in a proper size to prevent the shoes from being taken off from the foot, and should put on the shoes while the shoelace is loosely tied to the shoes. However, the shoelace should be fastened according to the size of the foot to the extent not pressing the foot while walking to secure the health of the foot.

However, fastening or unfastening the shoelace whenever a user puts on or takes off the shoes is troublesome and a user usually puts on the shoes by properly tying the shoelace except for the special case. In this case, however, the shoelace may be untied while walking and a user should stop walking and tie the shoelace again. Even if the shoelace is not untied, both end parts of the shoelace are not fixed and thus an indecent image may be caused and this is even so when the shoelace is long.

Further, it is not easy to tie and untie the shoelace for lower graders at elementary schools and preschool children and seniors. In particular, in the case of cycling race players or mountain climbers, both end parts of the unfixed shoelace or the shoelace untied by intense movements or external object may cause undesirable result such as worse performance results or occurrence of accident and the shoelace should be prevented from being untied.

During break from exercise, a user may take a rest fully when the tightly fastened shoelace is easily untied. Preferably, the shoelace should be easily fastened, maintain the fastened status and at the same be unfastened easily whenever necessary.

To ensure easy fastening and unfastening of the shoelace, apparatuses for easily fastening the shoelace have been developed. Korean Patent No. 598627 which has been filed by the present applicant discloses a shoelace fastener which employs a ratchet gear. A user should turn a rotating member and wind the shoelace and then push to one side, and grabs, a stopper with his/her hand when unfastening the shoelace. This causes inconvenience and is difficult to use for children or seniors or the underprivileged.

If a user does not properly push the stopper to one side when unfastening the shoelace, the unfastening process is suspended and thus reliability of the shoelace fastener deteriorates. If an additional stopper fixing member is installed within the rotating member to solve the foregoing problem, the structure is complicated and the number of parts used for manufacturing the shoelace fastener increases and productivity is significantly decreased.

SUMMARY

It is an aspect of the present invention to provide an apparatus for fastening a shoelace which is easy to configure and manipulate and provides improved convenience and productivity.

In order to achieve an aspect of the present invention, an apparatus for fastening a shoelace may be provided. The apparatus may comprise a housing which comprises a ratchet gear provided in an internal circumference thereof and includes a cylindrical internal surface; a rotating cover which rotatably covers an upper part of the housing and includes a restricting projection protruding from a lower surface thereof; a reel part which is rotatably provided and coupled to a rotating shaft in an internal lower part of the housing and has a wire wound thereto and a coupling accommodation part formed in an upper part thereof; and a restricting member which comprises a repulsion restricting part which is provided between the rotating cover and the reel part and includes a ratchet coupling part protruding from an external circumference thereof to restrict a rotation in one direction by the ratchet gear, and a pressure coupling part which is slidably contacted and pressed by a rotation of the restricting projection in the other direction along a rotational radius and is repulsively deformed and selectively coupled to the coupling accommodation part.

A second end part of the repulsion restricting part may be detachably coupled to an accommodation groove formed in an inside of the restricting member.

The coupling accommodation part may comprise a plurality of coupling grooves which are formed in a circumferential direction in an upper surface of the reel part, and the pressure coupling part comprises an inclined surface which is contacted and pressed in a rotational radius of the restricting projection at its upper surface, and an elastic coupling piece which is repulsively deformed selectively and is coupled to the coupling groove when the inclined surface is pressed.

The elastic coupling piece may be formed integrally in the restricting member.

The coupling accommodation part may comprise a tooth projection part which protrudes from an upper part of the reel part, and the pressure coupling part comprises an inclined surface which is contacted and pressed at its external lateral surface by a rotation of the restricting projection along a rotational radius, and an elastic tooth piece which has a tooth coupling part formed in an internal circumference to be repulsively deformed to be selectively closed when the inclined surface is pressed but to be coupled to the tooth projection part.

As described above, the apparatus for fastening a shoelace according to an embodiment of the present invention may provide the following effects:

First, the apparatus for fastening a shoelace according to the present invention is integrally coupled to a shoelace and attached to shoes and enables a user to fasten or unfasten the shoelace by rotating a rotating cover in clockwise or counterclockwise direction and significantly improve user convenience through simple manipulation.

Second, as the pressure coupling part of the restricting member is selectively coupled to the coupling accommodation part of the reel part only by rotating the rotating cover in one direction or the other direction, the coupling state of the restricting member and the reel part may be conveniently adjusted without manipulating the rotating cover additionally upwards or downwards. Thus, inconvenience due to error or malfunction is prevented and user convenience may be significantly improved.

Third, if the rotating cover is rotated in one direction, the pressure coupling part is coupled to the coupling accommodation part. Thus, the rotating cover, the restricting member and the reel part integrally rotate and wind the wire. If the rotating cover is rotated in the other direction at a predetermined angle, the pressure coupling part is decoupled from the coupling accommodation part and the restricting member and the reel part may independently rotate. If both ends of the wire exposed to the outside of the housing are pulled, the wire may be loosened. Accordingly, fastening and unfastening processes for the wire is very simple and even seniors and children may manipulate the wire without difficulty and product reliability may be significantly improved.

The foregoing and other aspects will become apparent from the following detailed description when considered in conjunction with the accompanying drawing figures.

BEST MODE

Figure 1:
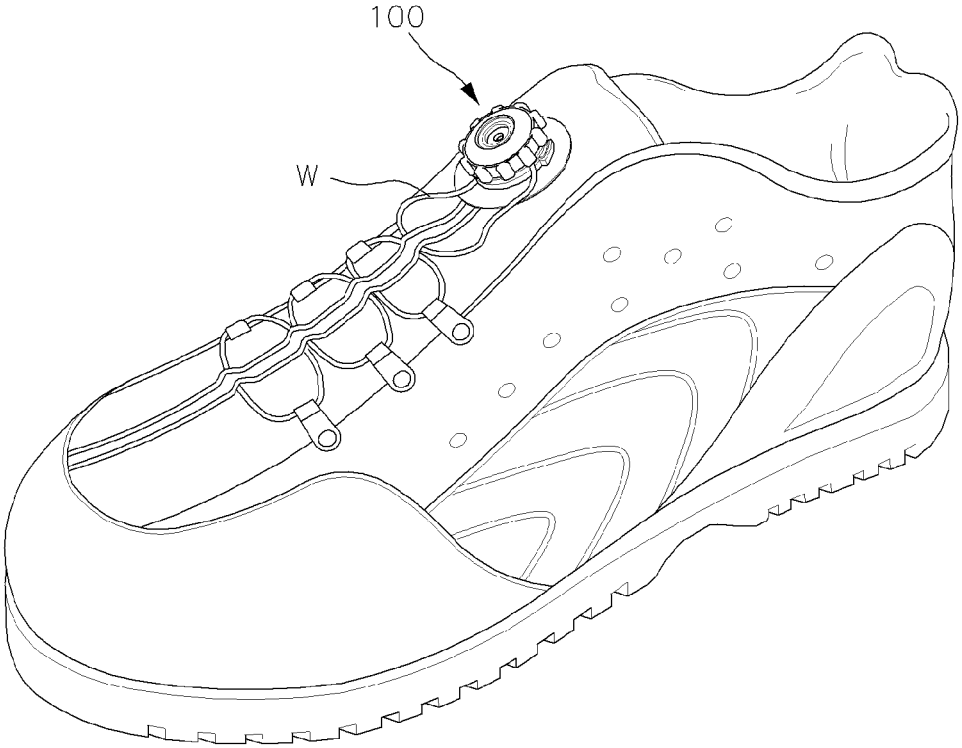
FIG. 1 is a perspective view of an apparatus for fastening a shoelace according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below to explain the present invention by referring to the figures.

As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". References to "an" or "one" embodiment are not necessarily all referring to the same embodiment. Elements from an embodiment may be combined with elements of another. No element used in the description of this application should be construed as critical or essential to the invention unless explicitly described as such. Further, when an element is described as "connected," "coupled," or otherwise linked to another element, it may be directly linked to the other element, or intervening elements may be present.

FIG. 1 is a perspective view of an apparatus for fastening a shoelace according to an exemplary embodiment of the present invention.

As shown therein, an apparatus for fastening a shoelace 100 according to the exemplary embodiment of the present invention may be attached to an upper surface of a shoe tongue, or to a lateral part of a shoe depending on design, etc. As a rotating cover of the apparatus for fastening a shoelace 100 is rotated, a wire w may be wound and pulled. Then, the wire w may be properly fastened according to a user's foot size including the width and height of the foot and guarantees a comfortable walk.

Figure 2:
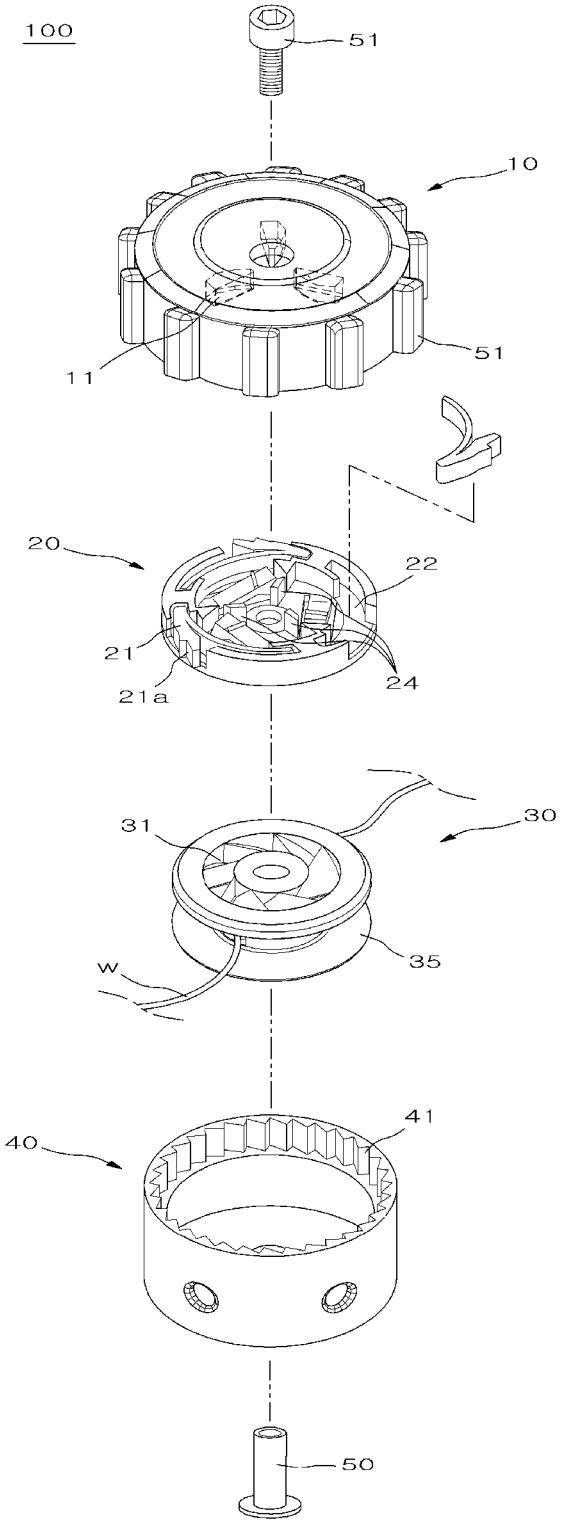
FIG. 2 is an exploded perspective view of the apparatus for fastening a shoelace according to the exemplary embodiment of the present invention.

FIG. 2 is an exploded perspective view of the apparatus for fastening a shoelace 100 according to the exemplary embodiment of the present invention.

As shown therein, the apparatus for fastening a shoelace 100 according to the exemplary embodiment of the present invention may include a housing 40, a rotating cover 10, a reel part 30 and a restricting member 20.

A ratchet gear 41 may be provided in an internal upper part of the housing 40 and a lower surface of the housing 40 may be fixed to an external surface of the shoe. The housing 40 may have a cylindrical internal surface and sequentially accommodate therein the reel part 30 and the restricting member 20.

The rotating cover 10 may rotatably cover an upper opening surface of the housing 40. The housing 40 and the rotating cover 10 may be coupled to a rotating shaft 50 which passes through and rotatably supports the reel part 30 and the restricting member 20. An upper end of the rotating shaft 50 may be rotatably supported by a coupling means 51 such as a bolt coupled by passing through the rotating cover 10.

A plurality of restricting projections 11 may be formed and protrude downwardly from a lower surface of the rotating cover 10, and a friction part 15 which has a frictional projection is provided at a predetermined interval in a circumferential direction in an external circumference of the rotating cover 10. The friction part 15 may include an elastic material such as synthetic rubber to be easily rotated by the pressure of a user's finger, etc.

The reel part 30 may be coupled to the rotating shaft 50 and may be rotatably provided in an internal lower part of the housing 40 and has the wire w wound thereto. To do the foregoing, a winding part 35 may be formed in a central part of the reel part 30 in a circumferential direction to selectively wind or unwind the wire w. The winding part 35 may be shaped like a groove. The wire w may pass through a lateral part of the housing 40 and be exposed to the outside to fasten or unfasten the shoelace. A coupling accommodation part may be formed in an upper part of the reel part 30. The coupling accommodation part may include a plurality of coupling grooves 31 which may be formed in an upper surface of the reel part 30 in a circumferential direction.

The restricting member 20 may be provided between the rotating cover 10 and the reel part 30, and includes a repulsion restricting part 21 and a pressure coupling part.

The repulsion restricting part 21 may have a ratchet coupling part 21*a* protruding from an external circumference of the repulsion restricting part 21 to cause a rotation in one direction to be restricted by the ratchet gear 41. More specifically, the repulsion restricting part 21 may extend in a circumferential direction along an external circumferential profile of the restricting member 20, and the ratchet coupling part 21*a* may be formed in an end part of the repulsion restricting member 20 which is bent oppositely from the extending part. With the foregoing configuration that extends as a bent shape, referring to FIG. 2, the repulsion restricting part 21 may efficiently restrict a counterclockwise rotation of the restricting member 20 with a sufficient distance secured for an elastic deformation, and may allow a clockwise rotation to be repulsively deformed from the bent part and to be smooth along an inclined surface of the ratchet gear 41.

Then, the restricting member 20 may maintain a non-rotation state in one direction (counterclockwise direction in FIG.

2) due to the restriction between the ratchet gear 41 and the ratchet coupling part, but may rotate in the other direction (clockwise direction in FIG. 2). In connection with the restricting projection 11 of the rotating cover 10 and the restricting member 20, within a space formed between restricting ribs 24 formed at a predetermined interval in the restricting member 20 provided in a circumferential direction, the restricting projection 11 may not be restricted even in the case of a counterclockwise rotation.

The repulsion restricting part 21 may be integrally formed in the restricting member 20, or may be detachably provided so that an end part of the repulsion restricting part 21 is coupled to an accommodation groove 22 formed in the restricting member 20. Thus, in the case of damage to the repulsion restricting part 21, the repulsion restricting part 21 may be replaced with a new part for maintenance.

The pressure coupling part may be slidably contacted, pressed, repulsively deformed and selectively coupled to the coupling accommodation part when the restricting projection 11 rotates in the other direction along a rotational radius. More specifically, the pressure coupling part may form an inclined surface of which an upper surface is contacted along a rotational radius of the restricting projection 11 and is downwardly pressed as the restricting projection 11 rotates, and include an elastic coupling piece 25 (FIG. 3*a*) which is selectively deformed repulsively and has a lower part selectively coupled to the coupling groove 31 when the inclined surface is pressed.

The restricting member 20 may be formed by injection molding and include synthetic resin. In the case of injection molding, the elastic coupling piece 25 may be integrally formed in the restricting member 20.

While the elastic coupling piece 25 is inserted into and coupled to the coupling groove 31 of the reel part 30, the restricting member 20 and the reel part 30 may rotate integrally. If an external force is applied to the rotating cover 10 in a clockwise direction, the external force is sequentially transmitted to the rotating cover 10, the restricting projection 11, the restricting rib 24, the restricting member 20, the elastic coupling piece 25, the coupling groove 31 and the reel part 30.

On the contrary, if the elastic coupling piece 25 is released from pressure and is separated from the coupling groove 31, the restricting member 20 and the reel part 30 may rotate independently. That is, depending on the coupling/decoupling state of the elastic coupling piece 25 as the pressure coupling part and the coupling groove 31 as the coupling accommodation part, the restricting member 20 and the reel part 30 may rotate together or independently.

The coupling groove 31 may be formed as a groove between ratchet gear teeth having an inclined surface so that a lower part of the elastic coupling piece 25 may be efficiently inserted into and coupled to the coupling groove 31.

The coupling structure of the pressure coupling part and the coupling accommodation part will be described in detail.

Figure 3A:
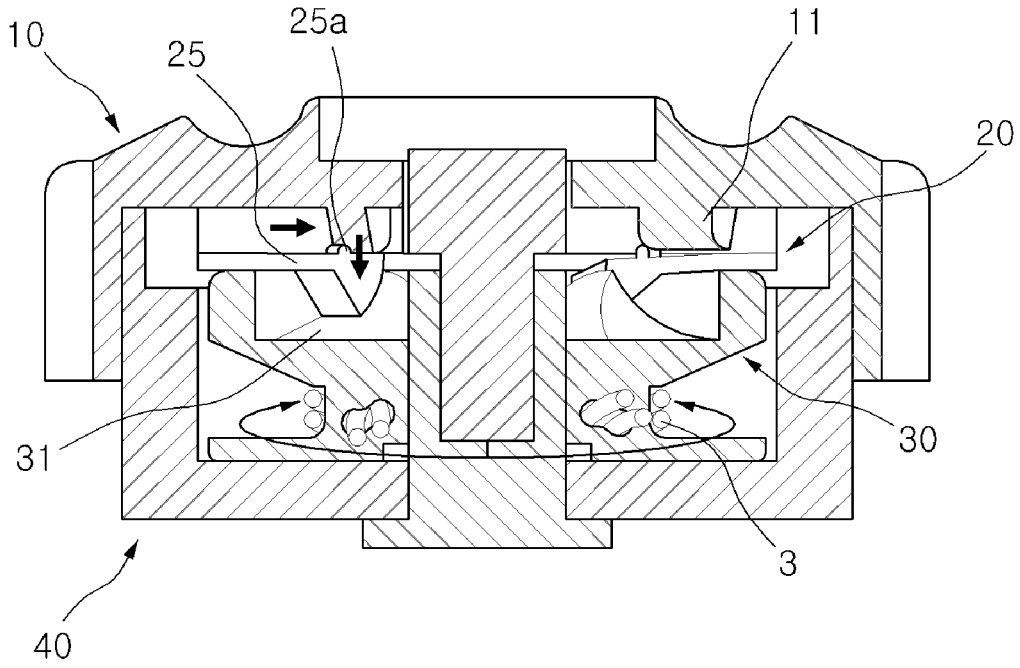
FIGS. 3*a* and 3*b* are longitudinal sectional views of an interaction between a pressure coupling part and coupling accommodation part which apply to the exemplary embodiment of the present invention.
Figure 3B:
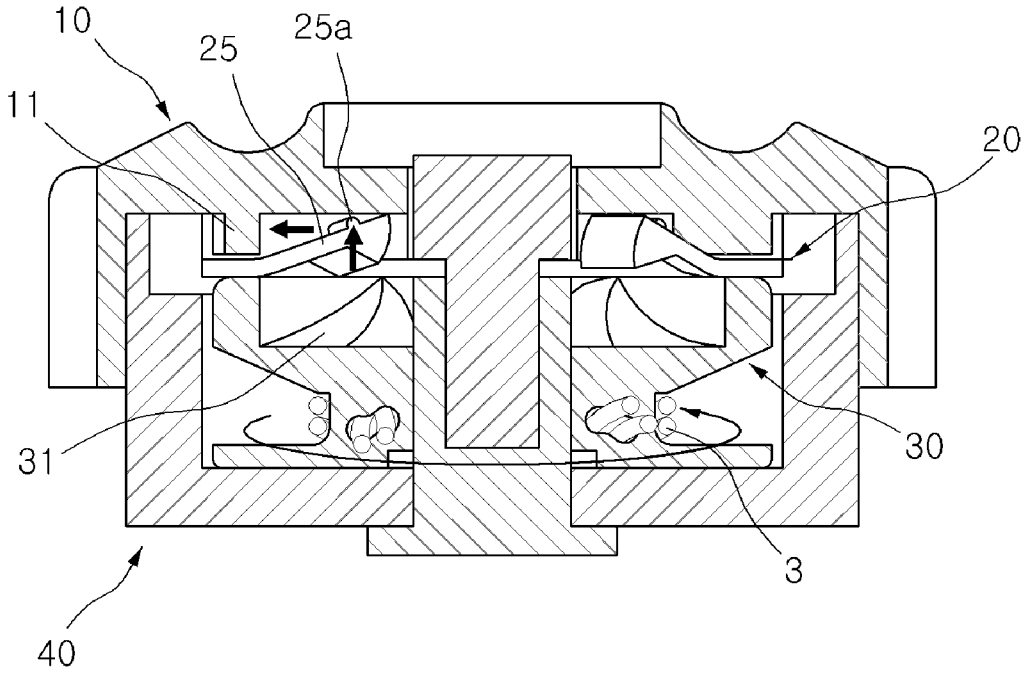

FIGS. 3*a* and 3*b* are longitudinal sectional views of an interaction between the pressure coupling part and the coupling accommodation part which apply to the exemplary embodiment of the present invention.

Referring to FIGS. 2 and 3*a*, if a user rotates the rotating cover 10 in a clockwise direction, the restricting projection 11 which protrudes from the lower surface of the rotating cover 10 may be slidably contacted in a direction where the inclined surface of the elastic coupling piece 25 of the restricting member 20 rises, and is downwardly pressed. As the lower part of the elastic coupling piece 25 is inserted into and restricted by the coupling groove 31 of the reel part 30, the rotating cover 10, the restricting member 20 and the reel part 30 may rotate integrally. Accordingly, the reel part 30 may rotate in a clockwise direction and the wire w is wound.

After the wire w is wound to properly fasten the shoes and the external force applied by a user is suspended, the restricting member 20 may maintain a non-rotation state due to the restriction of rotation in the other direction by the ratchet gear 41 and the ratchet coupling part 21*a*. Thus, the wire w may maintain the fastened state.

A step projection 25*a* may be formed on a top of the inclined surface of the elastic coupling piece 25, and the bottom of the restricting projection 11 may slide along the inclined surface and be held by the step projection 25*a* and thus the top of the elastic coupling piece 25 may stably maintain the downward pressing state.

On the contrary, referring to FIGS. 2 and 3*b*, if a user applies an external force and rotates the rotating cover 10 in a counterclockwise direction at a predetermined angle to unwind the wire w, the restricting projection 11 may pass the step projection 25*a* and may be slidably contacted in a direction where the inclined surface of the elastic coupling piece 25 moves downwardly and may be released from the pressure. The restricting member 20 including the elastic coupling piece 25 may not rotate in one direction (counterclockwise direction in FIG. 2) due to the restriction of the ratchet gear 41 and the ratchet coupling part 21*a*.

If the pressure to the elastic coupling piece 25 is released, the elastic coupling piece 25 may rise and may be decoupled from the coupling groove 31 due to the repulsive recovering force. The restricting member 20 and the reel part 30 may rotate independently. In this state, if a user pulls both ends of the wire w, the reel part 30 rotates independently and the wire w is conveniently unwound.

That is, if the rotating cover 10 is rotated in a counterclockwise direction at a predetermined angle enough to release the pressure of the elastic coupling piece 25 and both ends of the wire w exposed to the outside of the housing 40 are pulled, the reel part 30 may freely rotate and the wire w functioning as a shoelace may be loosened. Accordingly, fastening and unfastening processes of the wire w are very simple and even seniors and children may easily manipulate the wire w.

Figure 4A:
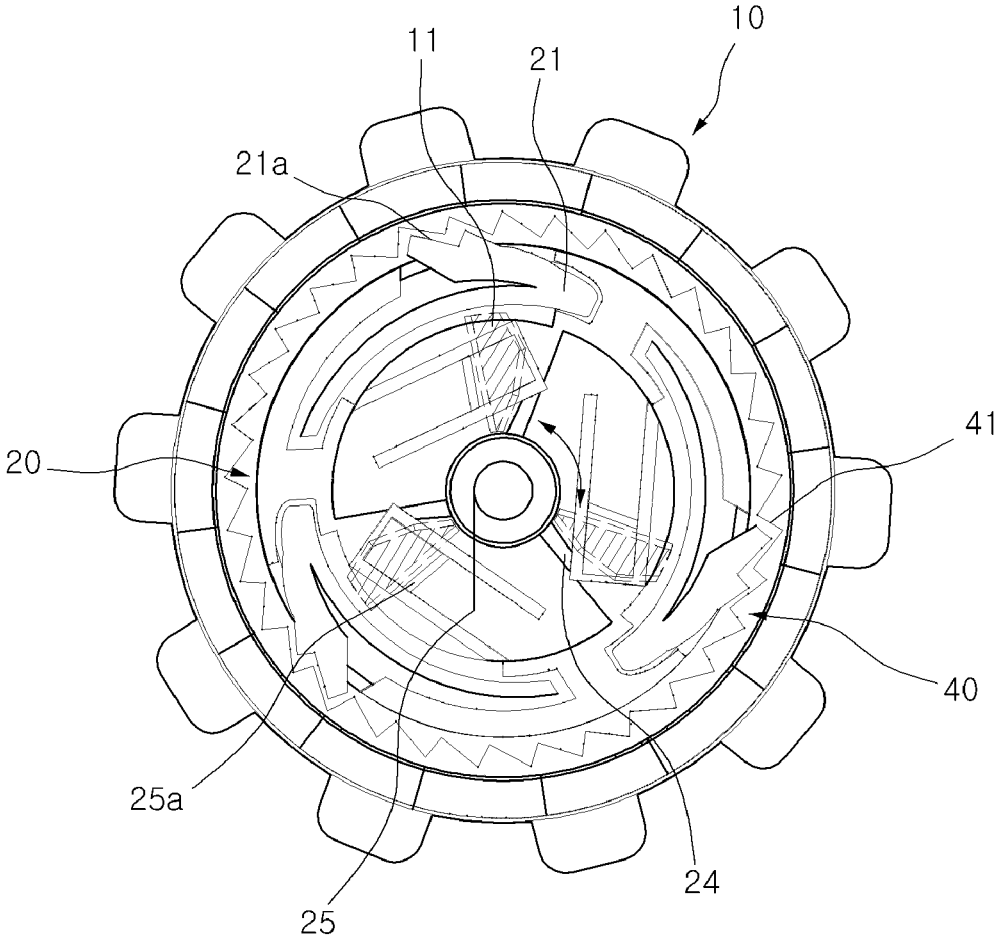
FIGS. 4*a* and 4*b* are cross sectional views of an interaction between a rotating cover and a restricting member according to the exemplary embodiment of the present invention.
Figure 4B:
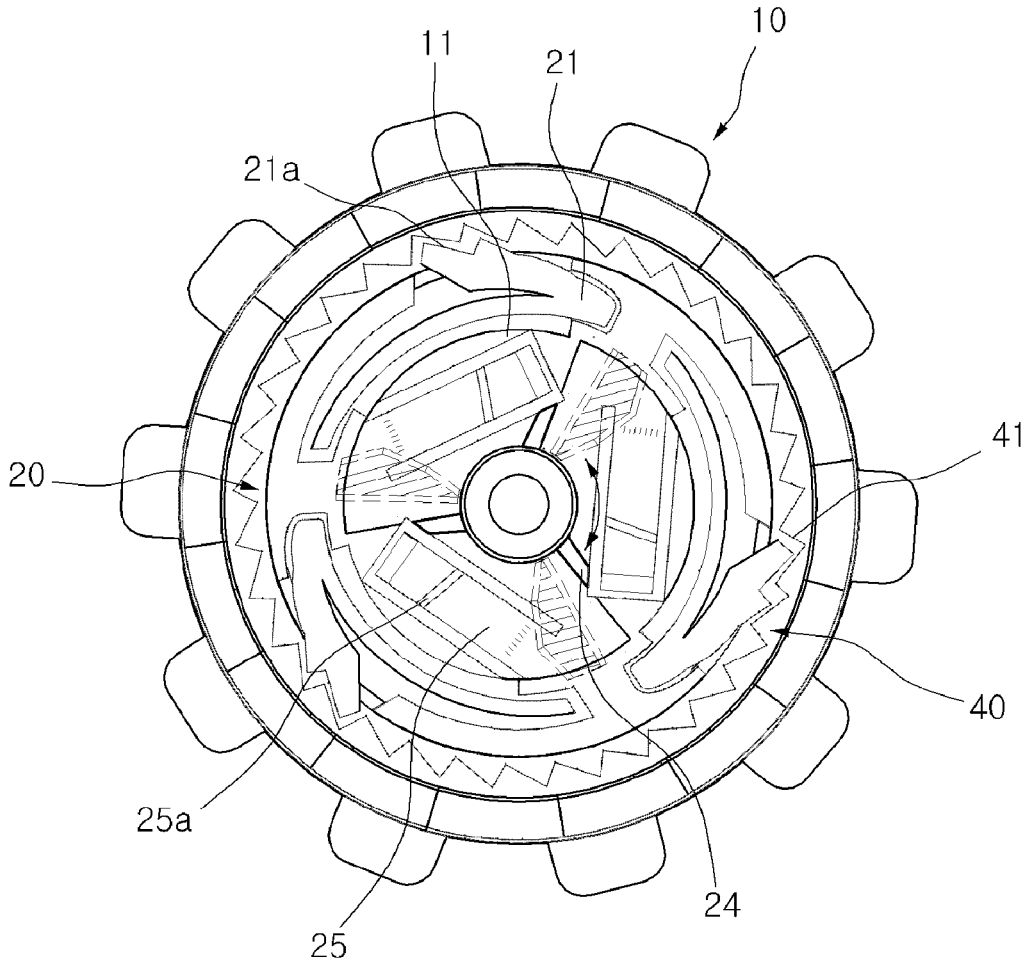

FIGS. 4*a* and 4*b* are cross sectional views of an interaction between the rotating cover 10 and the restricting member 20 according to the exemplary embodiment of the present invention.

Referring to FIGS. 2 and 4*a*, as the repulsion restricting part 21 of the restricting member 20 is restricted by the ratchet gear 41, the rotation of the restricting member 20 in one direction (counterclockwise direction in FIG. 2) may be restricted by the ratchet gear 41 formed in the housing 40 due to the external force applied to the rotating cover 10, and the rotation of the restricting member 20 in the other direction (clockwise direction in FIG. 2) may be available.

If the rotating cover 10 is rotated in a clockwise direction by the external force, the restricting projection 11 in a lower surface of the rotating cover 10 may rotate in a clockwise direction and may be contacted by the restricting rib 24 formed in the restricting member 20 and transmit the rotation force to rotate the restricting member 20 in a clockwise direction. Concurrently, as described with reference to FIG. 3*a*, if the elastic coupling piece 25 pressed by the restricting projection 11 is coupled to the coupling groove 31, the reel part 30 may be rotated in a clockwise direction together with the restricting member 20 and the wire w may be wound. The wound wire w may not rotate in a counterclockwise direction, i.e., unwinding direction and may maintain the wound state.

As shown in FIGS. 2 and 4*b*, the restricting projection 11 may rotate in a counterclockwise direction within a space between the restricting ribs 24 protruding from the restricting member 20. If the rotating cover 10 is rotated in a counterclockwise direction at a predetermined angle, the restricting projection 11 may be moved in a direction releasing the pressure of the elastic coupling piece 25. Accordingly, as shown in FIG. 3*b*, the elastic coupling piece 25 may be decoupled from the coupling groove 31, and the restricting member 20 and the reel part 30 may rotate independently.

If the both ends of the wire w exposed to the outside of the housing 40 are pulled, the wire w functioning as the shoelace may be untied or loosened.

Figure 5:
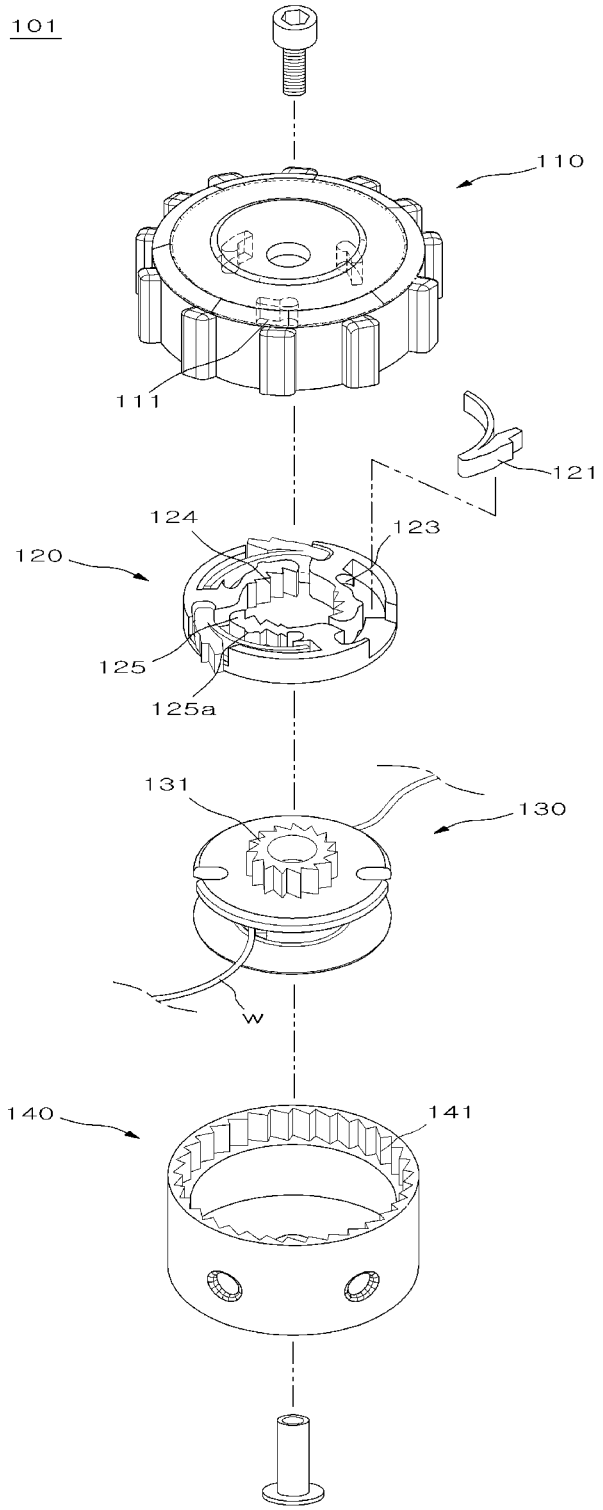
FIG. 5 is an exploded perspective view of an apparatus for fastening a shoelace according to another exemplary embodiment of the present invention.

FIG. 5 is an exploded perspective view of an apparatus for fastening a shoelace according to another exemplary embodiment of the present invention. An apparatus for fastening a shoelace 101 according to the present exemplary embodiment may have the same basic configuration as the configuration of the foregoing exemplary embodiment except for the detailed configuration of the pressure coupling part of a restricting member and a coupling accommodation part of a reel part. Thus, repetitive description will be omitted.

As shown in FIG. 5, a repulsion restricting part 121 of a restricting member 120 may be restricted in rotation in one direction (counterclockwise direction in FIG. 5) by a ratchet gear 141 of a housing 140, and the restricting member 120 may rotate in the other direction only (clockwise direction in FIG. 5).

A restricting projection 111 which protrudes from a lower surface of a rotating cover 110 may be inserted into a guiding groove 123 formed in the restricting member 120. A tooth coupling part 124 which may be selectively coupled to a tooth projection part 131 of the reel part 130 may be formed in an internal circumference of the guiding groove 123 to form an elastic tooth piece 125 which is elastically open and closed.

More specifically, the coupling accommodation part which is provided in the reel part 130 to which the wire w is wound may include a tooth projection part 131 which may protrude from an upper part of the reel part 130. The pressure coupling part which is provided in the restricting member 120 may include an elastic tooth piece 125. The elastic tooth piece 125 may include an inclined surface which is pressed by the rotation of the restricting projection 120 at its external lateral surface, and a tooth coupling part 126 which is repulsively deformed to be selectively closed inwardly when the inclined surface is pressed and is coupled to the tooth projection part 131 in its internal circumference may be formed. A step part 125*a* may be formed in the inclined surface to be contacted and restrict the rotated restricting projection 111 to maintain the pressure applied to the elastic tooth piece 125.

The inclined surface which is formed in an external lateral surface of the elastic tooth piece 125 is formed to be inclined in a direction where it is pressed by the rotation of the restricting projection 111 in one direction and is released from the pressure by the rotation of the restricting projection 111 in the other direction.

If a user applies an external force to the rotating cover 110 and the restricting projection 111 rotates in a clockwise direction, the internal lateral surface of the restricting projection 111 may be slidably contacted by the inclined surface of the elastic tooth piece 125 and presses the inside. Then, the tooth coupling part 126 which is formed in an internal circumference of the elastic tooth piece 125 may be coupled to the tooth projection part 131, and the restricting member 120 and the reel part 130 may rotate integrally. Accordingly, the reel part 130 may rotate in a clockwise direction to wind the wire w.

If the restricting projection 111 rotates in a counterclockwise direction, the restricting projection 111 may be slidably contacted by the inclined surface of the elastic tooth piece 125 and release the pressure. As the tooth coupling part 126 is decoupled from the tooth projection part 131, the restricting member 120 and the reel part 130 rotate independently.

That is, if the rotating cover 110 is rotated in a counterclockwise direction at a predetermined angle to release the pressure from the elastic tooth piece 125 and the both ends of the wire w exposed to the outside of the housing 140 are pulled, the reel part 130 may freely rotate and the wire w functioning as the shoelace may be loosened. Accordingly, manipulation for fastening and unfastening the wire w is very simple and even seniors and children may easily adjust the wire w.

Although embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An apparatus for fastening a shoelace, the apparatus comprising:

a housing which comprises a ratchet gear provided in an internal circumference thereof and includes a cylindrical internal surface;

a rotating cover which rotatably covers an upper part of the housing and includes a restricting projection protruding from a lower surface thereof;

a reel part which is rotatably provided and coupled to a rotating shaft in an internal lower part of the housing and includes a wire wound thereto and a coupling accommodation part formed in an upper part thereof; and a restricting member which comprises a repulsion restricting part which is provided between the rotating cover and the reel part and includes a ratchet coupling part protruding from an external circumference thereof to restrict a rotation in one direction by the ratchet gear, and a pressure coupling part which is slidably contacted and pressed by a rotation of the restricting projection in the other direction along a rotational radius and is repulsively deformed and selectively coupled to the coupling accommodation part.

2. The apparatus according to claim 1, wherein a second end part of the repulsion restricting part is detachably coupled to an accommodation groove formed in an inside of the restricting member.

3. The apparatus according to claim 1, wherein the coupling accommodation part comprises a plurality of coupling grooves which are formed in a circumferential direction in an upper surface of the reel part, and the pressure coupling part comprises an inclined surface which is contacted and pressed in a rotational radius of the restricting projection at its upper surface, and an elastic coupling piece which is repulsively deformed selectively and is coupled to the coupling groove when the inclined surface is pressed.

4. The apparatus according to claim 3, wherein the elastic coupling piece is formed integrally in the restricting member.

5. The apparatus according to claim 1, wherein the coupling accommodation part comprises a tooth projection part which protrudes from an upper part of the reel part, and the pressure coupling part comprises an inclined surface which is contacted and pressed at its external lateral surface by a rotation of the restricting projection along a rotational radius, and an elastic tooth piece which has a tooth coupling part formed in an internal circumference to be repulsively deformed to be selectively closed when the inclined surface is pressed but to be coupled to the tooth projection part.

* * * * *